US011281128B2

(12) United States Patent
Kameyama et al.

(10) Patent No.: US 11,281,128 B2
(45) Date of Patent: Mar. 22, 2022

(54) ELECTROPHOTOGRAPHIC BELT AND ELECTROPHOTOGRAPHIC IMAGE FORMING APPARATUS USING THE ELECTROPHOTOGRAPHIC BELT

(71) Applicant: CANON KABUSHIKI KAISHA, Tokyo (JP)

(72) Inventors: Naoto Kameyama, Tokyo (JP); Kaoru Okamoto, Chiba (JP); Atsushi Hori, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/245,984

(22) Filed: Apr. 30, 2021

(65) Prior Publication Data

US 2021/0341859 A1 Nov. 4, 2021

(30) Foreign Application Priority Data

May 1, 2020 (JP) ..... JP2020-081497
Apr. 6, 2021 (JP) ..... JP2021-064773

(51) Int. Cl.
*G03G 15/16* (2006.01)

(52) U.S. Cl.
CPC ..... *G03G 15/162* (2013.01); *G03G 15/161* (2013.01); *G03G 15/1685* (2013.01); *G03G 2215/1623* (2013.01)

(58) Field of Classification Search
CPC ..... G03G 15/162; G03G 15/161; G03G 15/1685; G03G 2215/1623
See application file for complete search history.

(56) References Cited

U.S. PATENT DOCUMENTS

| | | | | |
|---|---|---|---|---|
| 5,978,638 | A | 11/1999 | Tanaka | |
| 9,348,253 | B2 * | 5/2016 | Kanno | G03G 9/08755 |
| 2013/0149540 | A1 | 6/2013 | Sato | |
| 2014/0296363 | A1 | 10/2014 | Saegusa | |
| 2017/0060037 | A1 * | 3/2017 | Nameki | G03G 15/5054 |
| 2019/0004454 | A1 | 1/2019 | Karube | |

FOREIGN PATENT DOCUMENTS

| | | | |
|---|---|---|---|
| JP | 0597266 | A | 4/1993 |
| JP | 10186893 | A | 7/1998 |
| JP | 2014081603 | A | 5/2014 |
| JP | 2014209179 | A | 11/2014 |
| JP | 2016114907 | A | 6/2016 |
| JP | 2019012265 | A | 1/2019 |

OTHER PUBLICATIONS

Lopez, G., et al., "An amphiphilic PEG-b-PFPE-b-PEG triblock copolymer: synthesis by CuAAC click chemistry and self-assembly in water", Polymer Chemistry, 2016, pp. 402-409, vol. 7.

* cited by examiner

*Primary Examiner* — Ryan D Walsh
(74) *Attorney, Agent, or Firm* — Canon U.S.A., Inc., IP Division

(57) ABSTRACT

An electrophotographic belt having an endless shape and including an endless-shaped base layer, an elastic layer on an outer peripheral surface of the base layer, and a surface layer on the outer peripheral surface of the elastic layer, and the surface layer contains a urethane resin as a binder, polytetrafluoroethylene particles, and a compound having a perfluoropolyether structure and an oxyalkylene structure.

14 Claims, 3 Drawing Sheets

ELECTROPHOTOGRAPHIC BELT AND ELECTROPHOTOGRAPHIC IMAGE FORMING APPARATUS USING THE ELECTROPHOTOGRAPHIC BELT

BACKGROUND

The present disclosure relates to an electrophotographic belt that can be used as, for example, an intermediate transfer belt in an electrophotographic image forming apparatus such as a copier or a printer, and an electrophotographic image forming apparatus.

DESCRIPTION OF THE RELATED ART

In the electrophotographic image forming apparatus, a tandem method is widely adopted in which toner images of YMCK colors are superposed on an intermediate transfer belt and then collectively transferred onto paper or the like to obtain a full-color image. In such an electrophotographic image forming apparatus, an electrophotographic belt having an elastic layer may be used as an intermediate transfer belt in order to further improve an image quality of an electrophotographic image. Such an electrophotographic belt can reduce pressure acting on toner in a secondary transfer portion, and can suppress the occurrence of an image harmful effect called a so-called image loss. Since adhesion between the electrophotographic belt and the paper in the secondary transfer portion is excellent, it is also effective in improving secondary transferability of the toner onto thick paper or paper having irregularities.

In order to further improve transfer efficiency of the toner to the paper in the secondary transfer portion, a toner carrying surface (hereinafter, also referred to as "outer surface") of the electrophotographic belt may be composed of a surface layer having excellent toner releasability.

Here, Japanese Patent Application Laid-Open No. 2016-114907 discloses an electroconductive elastic belt having an electroconductive rubber base material, a release layer as a protective layer provided on the rubber base material, and an intermediate layer provided between the rubber base material and the release layer and having a Martens hardness lower than that of the release layer. It is further disclosed that it is preferable to use, as a resin in the release layer, a urethane resin in that the urethane resin easily follows elongation due to a change in a usage environment of a belt base material. In addition, it is described that it is preferable to use polytetrafluoroethylene (PTFE) as a lubricant for the release layer.

According to the study by the present inventors, in an electrophotographic belt having an elastic layer and a surface layer, in which the surface layer contains PTFE particles and a urethane resin as a binder resin, the PTFE particles in the surface layer have been unevenly distributed on a side of the surface layer close to the elastic layer. It is considered that this is because the PTFE particles have a heavier specific gravity than the urethane resin. In the electrophotographic belt including such a surface layer, the content of the PTFE particles changes as the surface layer wears with use, and accordingly, the toner releasability and cleaning properties of the outer surface of the electrophotographic belt may change.

SUMMARY

One aspect of the present disclosure is directed to providing an electrophotographic belt whose toner releasability and cleaning properties are less likely to change even after long-term use. Another aspect of the present disclosure is directed to providing an electrophotographic image forming apparatus capable of stably forming a high-quality electrophotographic image.

One aspect of the present disclosure provides an electrophotographic belt having an endless shape, and the electrophotographic belt includes an endless-shaped base layer, an elastic layer on an outer peripheral surface of the base layer, and a surface layer on the outer peripheral surface of the elastic layer. In this electrophotographic belt, the surface layer includes a urethane resin as a binder, polytetrafluoroethylene particles, and a compound having a perfluoropolyether structure and an oxyalkylene structure.

Another aspect of the present disclosure provides an electrophotographic image forming apparatus including an image carrier that carries a toner image and an intermediate transfer belt that carries and conveys the toner image primarily transferred from the image carrier so as to secondarily transfer the toner image onto a transfer material, and in this electrophotographic image forming apparatus, the intermediate transfer belt is the above-mentioned electrophotographic belt.

Further features of the present disclosure will become apparent from the following description of exemplary embodiments with reference to the attached drawings.

DESCRIPTION OF THE EMBODIMENTS

Hereinafter, an electrophotographic belt having an endless belt shape according to one embodiment of the present disclosure will be described. The technical scope of the present disclosure is not limited to the following description.

Figure 1:
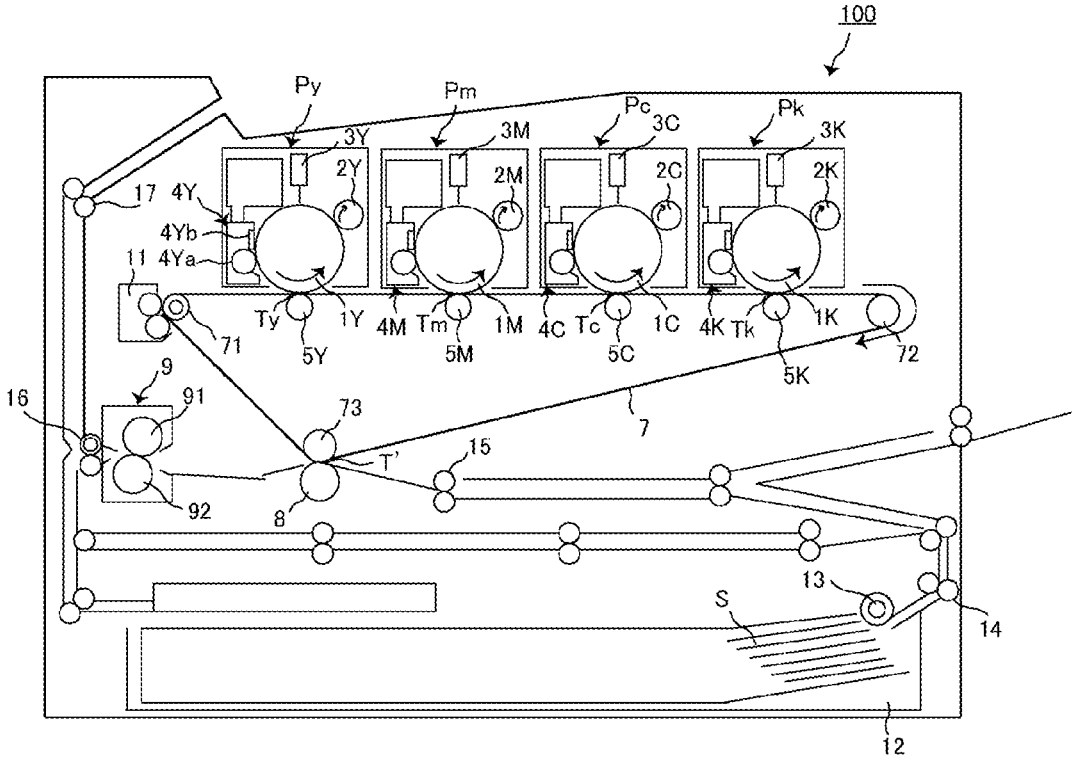
FIG. 1 is a cross-sectional view showing an example of an electrophotographic image forming apparatus using an electrophotographic belt according to one aspect of the present disclosure.

The electrophotographic belt is used, for example, as an intermediate transfer belt 7 in an electrophotographic image forming apparatus shown in FIG. 1.

Figure 2:
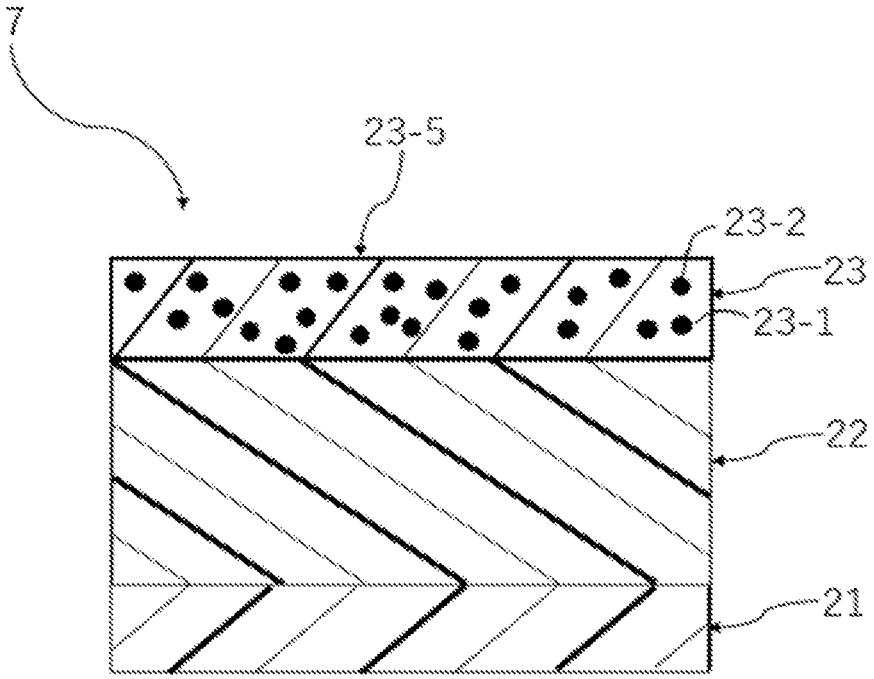
FIG. 2 is a cross-sectional view of the electrophotographic belt according to one aspect of the present disclosure.

FIG. 2 shows a cross section of the electrophotographic belt in a direction orthogonal to a circumferential direction. The electrophotographic belt has a structure in which a base layer 21, an elastic layer 22, and a surface layer 23 are stacked. However, the stacked layers are not limited to these three layers, and a primer layer for improving adhesion, a stress relaxation layer for suppressing cracking of the surface layer 23, and an intermediate layer for suppressing a bleeding component may be added between the respective layers.

(Base Layer)

The base layer 21 has an endless belt shape.

Examples of materials suitable for the base layer 21 include the following materials. Polyetheretherketone, polyethylene terephthalate, polybutylene naphthalate, polyester, polyimide, polyamide, polyamideimide, polyacetal, polyphenylene sulfide, polyvinylidene fluoride, and the like.

The resin for the base layer 21 may be imparted with electro-conductivity by adding an electroconductive compound such as a metal powder, an electroconductive oxide powder, an electroconductive carbon, a lithium salt, or an ionic liquid. In the following examples, polyvinylidene fluoride added with polyalkylene glycol and a lithium salt is used from the viewpoint of being capable of obtaining excellent productivity and conductivity. However, a combination of the other resins illustrated and an electroconductive agent may be used.

A thickness of the base layer 21 is preferably 10 to 500 μm. Within this range, it is possible to impart sufficient mechanical strength to the electrophotographic belt having an endless shape while maintaining its flexibility.

(Elastic Layer)

Since the elastic layer 22 follows a surface shape of a recording medium, the elastic layer 22 needs to have suitable flexibility. Examples of materials suitable for such an elastic layer include the following materials. Rubber materials and elastomer materials such as silicone rubber, urethane rubber, chloroprene rubber, acrylic rubber, olefin elastomer, styrene elastomer, polyamide elastomer, polyester elastomer, and polyurethane elastomer.

The elastic layer 22 may be imparted with electro-conductivity by adding an electroconductive compound such as a metal powder, an electroconductive oxide powder, an electroconductive carbon, a lithium salt, or an ionic liquid. In the following examples, a polyurethane elastomer added with polyalkylene glycol which is a thermoplastic elastomer and a lithium salt is used from the viewpoint of being capable of obtaining excellent productivity. However, a combination of the other resins illustrated and an electroconductive agent may be used.

A film thickness of the elastic layer 22 is preferably 100 to 1,000 μm, and more preferably 200 to 500 μm. A JIS-A hardness of the elastic layer 22 is preferably 80 degrees or less.

A blending amount of the electroconductive agent with respect to the elastic layer 22 is preferably 10 parts by mass or less, and more preferably 5 parts by mass or less with respect to 100 parts by mass of urethane resin. As a result, the elastic layer 22 is imparted with stable electro-conductivity suitable for an electrophotographic belt.

In addition, the elastic layer 22 may also contain additives such as a filler, a cross-linking accelerator, a cross-linking retarder, a cross-linking aid, an antiscorching agent, an anti-aging agent, a softening agent, a heat stabilizer, a flame retardant, a flame retardant aid, an ultraviolet absorber, and a rust inhibitor.

Since the electrophotographic belt is energized at a transfer portion, flame retardancy is required. It is difficult for various elastomers and rubbers to secure necessary flame retardancy when no flame retardant is added. Examples of flame retardants include metal hydroxides such as magnesium hydroxide and aluminum hydroxide that utilize heat absorption action, platinum compounds and phenolic compounds that suppress thermal decomposition, intumescent compounds that have an oxygen blocking effect, and phosphate ester condensed compounds.

Examples of the filler include reinforcing fillers such as fumed silica, crystalline silica, wet silica, fumed titanium oxide, and cellulose nanofibers.

In addition, a primer layer (not shown) may be provided between the base layer 21 and the elastic layer 22 in order to improve adhesive property, if necessary. The thickness of the primer layer is preferably 0.1 to 2 μm from the viewpoint of reducing cohesive failure in the primer layer.

(Surface Layer)

The surface layer 23 contains urethane resin 23-1 as a binder resin, PTFE particles 23-2, and a compound having a perfluoropolyether structure and an oxyalkylene structure (not shown).

The PTFE particles 23-1 impart excellent toner releasability and excellent cleaning properties to a surface (hereinafter, also referred to as "outer surface") 23-5 of the surface layer 23 on a side opposite to a side of the surface layer 23 that faces the elastic layer 22. The outer surface 23-5 of the surface layer constitutes the toner carrying surface of the electrophotographic belt 7.

The film thickness of the surface layer 23 is preferably 0.5 to 20.0 μm. This is because the surface layer follows deformation of the elastic layer well when the electrophotographic belt is used for forming an electrophotographic image, and the surface layer can be prevented from peeling from the elastic layer.

<Polytetrafluoroethylene (PTFE) Particles>

For a number average particle diameter of the polytetrafluoroethylene particles, it is preferable to appropriately select and use the polytetrafluoroethylene particles having a number average particle diameter of less than 2.00 μm, particularly in a range from 0.05 μm (50 nm) to 1.80 μm, based on the assumption that a protrusion due to the PTFE particles is prevented from being generated on the outer surface of the surface layer 23, that is, the outer surface of the electrophotographic belt.

Specific examples of the PTFE particles include "Fluon (registered trademark) PTFE Lub series" (trade name, manufactured by AGC Inc.) and "TLP 10F-1" (trade name, manufactured by Chemours-Mitsui Fluoroproducts Co., Ltd.).

<Urethane Resin>

Urethane resin is a resin containing urethane bond (—NH—(C=O)—O—).

The surface layer containing the urethane resin as the binder resin has excellent adhesion to the elastic layer, and can make the surface layer to follow elastic deformation of the elastic layer well.

A raw material for the urethane resin is not particularly limited, and a known polyurethane resin liquid can be used. Examples of commercially available polyurethane resin liquids include "Hydran WLS-201" (trade name, manufactured by DIC Corporation) and "UCECOAT 7850" (trade name, manufactured by Daicel-Allnex Ltd.).

<Compound Having Perfluoropolyether Structure and Oxyalkylene Structure>

The surface layer 23 further contains a compound (hereinafter sometimes referred to as "PFPE/OR compound") having a perfluoropolyether structure (not shown, hereinafter also referred to as "PFPE structure") and an oxyalkylene structure (not shown, hereinafter also referred to as "OR structure").

The PFPE/OR compound functions as a dispersant for dispersing the PTFE particles in the urethane resin. The PFPE/OR compound can make the PTFE particles to be uniformly present in a thickness direction of the surface layer 23. Thus, at least some of the PTFE particles are exposed on the outer surface of the electrophotographic belt from the beginning, or at least some of the PTFE particles are exposed at a very early stage of image formation. Thus, even in an electrophotographic belt that has just begun to be used, slidability between its outer surface and an abutting member like a cleaning blade is high, and an electrophotographic image can be stably formed from the beginning.

Since the PTFE particles are uniformly present in the thickness direction of the surface layer, even if the outer surface of the electrophotographic belt is worn by a rub with the abutting member, it is possible to keep a state where at least some of the PTFE particles are always exposed on the outer surface. Thus, excellent slidability between the outer surface of the electrophotographic belt and the abutting member is maintained for a long period of time.

In the PFPE/OR compound, a number average molecular weight of the PFPE structure is preferably 500 to 10,000, and more preferably 1,200 to 4,000.

The PFPE structure may be composed of only a linear structure or may have a part of a branched structure. Specific examples of the PFPE structure include at least one selected from the group consisting of structures represented by the following structural formulas (i) to (iv).

$$—CF_2O— \quad (i)$$

$$—CF_2CF_2O— \quad (ii)$$

$$—CF_2CF_2CF_2O— \quad (iii)$$

$$—CF(CF_3)CF_2O— \quad (iv)$$

The OR structure includes, for example, the structure represented by the following structural formula (v):

$$—[(CH_2)n\text{-}O]m\text{-} \quad (v)$$

In the formula (v), n represents an integer of 1 to 5, for example, and m represents an integer of 1 or more.

The preferred number of n is 2 to 3.

When the number average molecular weight of the oxyalkylene structure is defined as Mn1 and the number average molecular weight of the perfluoropolyether structure is defined as Mn2, a value of (Mn1/Mn2) is preferably 0.3 to 2.0, and more preferably 0.5 to 1.0. The PTFE particles can be more evenly dispersed in the urethane resin.

Examples of the PFPE/OR compound include a terpolymer synthesized by a reaction (azide-alkyne cycloaddition reaction) between an azide compound of a polyalkylene oxide and a diine of a perfluoropolyether in the presence of a copper catalyst. A method for synthesizing such a terpolymer is described, for example, in the literature by LOPEZ, Gerald, et al (Polymer Chemistry, 2016, 7.2: 402-409, "An amphiphilic PEG-b-PFPE-b-PEG triblock copolymer: synthesis by CuAAC click chemistry and self-assembly in water").

<Method of Forming Surface Layer>

As a method of producing the surface layer 23, for example, a paint for a surface layer containing a raw material of the urethane resin 23-1, the PTFE particles 23-2, and the compound having a PFPE structure and an oxyalkylene structure is applied by a known method such as a spray method or an immersion method to form a coating film of the surface layer paint on the elastic layer 22, and then the coating film is cured by heating or irradiation with radiation such as an electron beam or ultraviolet rays, whereby the surface layer 23 can be formed.

(Electrophotographic Image Forming Apparatus)

An example of an electrophotographic image forming apparatus using the electrophotographic belt according to the present embodiment as an intermediate transfer belt will be described with reference to FIG. 1. An electrophotographic image forming apparatus 100 shown in FIG. 1 is a color electrophotographic image forming apparatus (color laser printer). In this electrophotographic image forming apparatus, image forming units (Py, Pm, Pc, Pk) for respective colors of yellow (Y), magenta (M), cyan (C), and black (K) are arranged in this order in a moving direction of the intermediate transfer belt 7 along a flat portion of the intermediate transfer belt 7 which is an intermediate transfer body. The image forming units for respective colors each include an electrophotographic photosensitive member (1Y, 1M, 1C, 1K), a charging roller (2Y, 2M, 2C, 2K), a laser exposure device (3Y, 3M, 3C, 3K), and a developing device (4Y, 4M, 4C, 4K). The electrophotographic image forming apparatus 100 includes a primary transfer roller (5Y, 5M, 5C, 5K) at a position facing each of the photosensitive members with the intermediate transfer belt 7 interposed therebetween. Since the basic configuration of each image forming unit is the same, the yellow image forming unit Py will be described as details of the image forming unit.

The yellow image forming unit Py has the drum-type electrophotographic photosensitive member (hereinafter also referred to as "photosensitive drum" or "first image carrier") 1Y as an image carrier. The photosensitive drum 1Y is formed by stacking a charge generation layer, a charge transport layer, and a surface protection layer in this order on a cylinder made of aluminum as a substrate.

The yellow image forming unit Py includes the charging roller 2Y as a charging unit. By applying a charging bias to the charging roller 2Y, a surface of the photosensitive drum 1Y is uniformly charged.

The laser exposure device 3Y as an image exposure unit is arranged above the photosensitive drum 1Y. The laser exposure device 3Y scans and exposes the uniformly charged surface of the photosensitive drum 1Y according to image information to form an electrostatic latent image of a yellow color component on the surface of the photosensitive drum 1Y. The electrostatic latent image formed on the photosensitive drum 1Y is developed by the developing device 4Y as a developing unit with a toner as a developer. The developing device 4Y includes a developing roller 4Ya which is a developer carrying member and a regulating blade 4Yb which is a developer amount regulating member, and accommodates a yellow toner which is a developer. The developing roller 4Ya to which the yellow toner is supplied is lightly pressure-contacted with the photosensitive drum 1Y in a developing portion, and is rotated with a speed difference in a forward direction from the photosensitive drum 1Y. The yellow toner conveyed to the developing portion by the developing roller 4Ya adheres to the electrostatic latent image formed on the photosensitive drum 1Y by applying a developing bias to the developing roller 4Ya. As a result, a visible image (yellow toner image) is formed on the photosensitive drum 1Y.

The intermediate transfer belt 7 is extended over a drive roller 71, a tension roller 72, and a driven roller 73, and comes into contact with the photosensitive drum 1Y to be moved (rotationally driven) in a direction of an arrow in the drawing. The yellow toner image on the photosensitive drum (on the first image carrier) that has reached a primary transfer portion Ty is primarily transferred onto the intermediate transfer belt 7 by a primary transfer body (primary transfer roller 5Y) disposed to face the photosensitive drum 1Y via the intermediate transfer belt 7.

Similar to the yellow toner image, a magenta (M) toner image, a cyan (C) toner image, and a black (K) toner image are transferred onto the intermediate transfer belt 7 in the primary transfer portion (Tm, Tc, Tk) as the intermediate transfer belt 7 moves. The four color toner images transferred onto the intermediate transfer belt 7 in this way are conveyed according to the movement of the intermediate transfer belt 7, and in a secondary transfer portion T', the toner images are collectively transferred onto a transfer material S (hereinafter also referred to as "second image carrier"), conveyed at a predetermined timing, by a secondary transfer outer roller 8 and the secondary transfer inner roller 73 as a secondary transfer unit. In such secondary transfer, a transfer voltage of several kV is usually applied in order to secure a sufficient transfer rate.

The transfer material S is supplied from a cassette 12 storing the transfer material S to a conveyance path by a pickup roller 13. The transfer material S supplied to the conveyance path is conveyed to the secondary transfer portion T' in synchronization with the four color toner images transferred onto the intermediate transfer belt 7 by a conveyance roller pair 14 and a registration roller pair 15.

The toner image transferred onto the transfer material S is fixed by a fixing device 9, and becomes, for example, a full-color image. The fixing device 9 has a fixing roller 91 and a pressure roller 92 including a heater, and fixes an unfixed toner image on the transfer material S by heating and pressing the image. After that, the transfer material S is discharged to the outside of the machine by a conveyance roller pair 16, a discharge roller pair 17, and the like.

Figure 3:
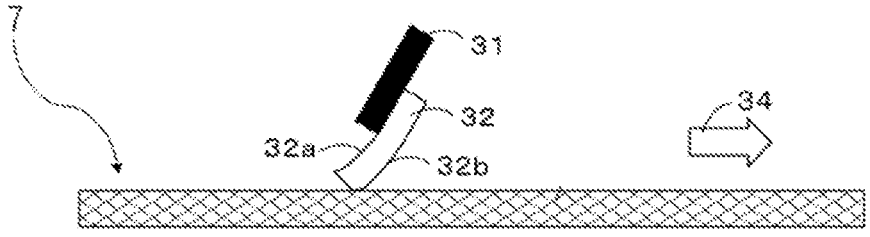
FIG. 3 is a view for explaining curling of a blade.

A cleaning unit 11 of the intermediate transfer belt 7 is arranged downstream of the secondary transfer portion T' in the driving direction of the intermediate transfer belt 7, and removes transfer remaining toner remaining on the intermediate transfer belt 7 without being transferred onto the transfer material S in the secondary transfer portion T'. Example of the cleaning unit 11 shown in FIG. 1 includes a cleaning unit including, as a cleaning member, a cleaning roller disposed in contact with an outer peripheral surface of the intermediate transfer belt 7. However, the cleaning member in the electrophotographic image forming apparatus according to the present disclosure is not limited to such a form. For example, as shown in FIG. 3, a cleaning blade 32 that is disposed so that at least a part is in contact with the outer peripheral surface of the intermediate transfer belt 7 can be provided as a cleaning member.

As described above, an electrical transfer process of the toner image from the photosensitive member to the intermediate transfer belt and from the intermediate transfer belt to the transfer material is repeated. By repeating recording on a large number of transfer materials, the electrical transfer process is further repeated.

According to one aspect of the present disclosure, it is possible to obtain an electrophotographic belt having an outer surface layer whose toner releasability and cleaning properties are less likely to change even after long-term use. According to another aspect of the present disclosure, it is possible to obtain an electrophotographic image forming apparatus capable of forming a high-quality electrophotographic image for a long period of time.

EXAMPLE (Preparation of Resin Pellet Body for Base Layer Formation)

The materials described in Table 1 below were kneaded using a twin-screw kneader (trade name: PCM30, manufactured by Ikegai Corp.) to obtain a resin pellet body.

TABLE 1

| Material | Blending amount (parts by mass) |
|---|---|
| Polyvinylidene fluoride (trade name: Solef 9007, manufactured by Solvay Specialty Polymers JAPAN K.K.) | 95 |

TABLE 1-continued

| Material | Blending amount (parts by mass) |
|---|---|
| Lithium perchlorate (anhydrous 98%, manufactured by Kanto Chemical Co., Ltd.) | 0.7 |
| Ethylene oxide-propylene oxide copolymer (trade name: Pluronic F-127, manufactured by BASF SE) | 4.3 |

(Preparation of Resin Pellet Body for Elastic Layer Formation)

The materials described in Table 2 below were kneaded using a twin-screw kneader (trade name: PCM30, manufactured by Ikegai Corp.) to obtain a resin pellet body.

TABLE 2

| Material | Blending amount (parts by mass) |
|---|---|
| Thermoplastic polyurethane (trade name: Elastollan 1175A10W; manufactured by BASF SE) | 98 |
| Lithium perchlorate (anhydrous 98%, manufactured by Kanto Chemical Co., Ltd.) | 0.2 |
| Ethylene oxide-propylene oxide copolymer (trade name: Pluronic F-127, manufactured by BASF SE) | 1.8 |

"Pluronic F-127" is a nonionic surfactant represented by the following structural formula. In the following structural formula, a, b, and c are integers of 1 or more, respectively.

$$HO—(CH_2CH_2O)a\text{-}(CH_2(CH(CH_3)O)b\text{-}(CH_2CH_2O)c\text{-}H$$

(Production of Two-Layer Belt Consisting of Base Layer and Elastic Layer)

Using the resin pellet body for base layer formation and the resin pellet body for elastic layer formation prepared above, a bi-layered laminated belt was produced by coextrusion.

Specifically, two single-screw extruders (trade name: GT40, manufactured by Research Laboratory of Plastics Technology Co., Ltd.) were provided. These single-screw extruders were connected to a cylindrical die for coextrusion. Then, the resin pellet body for base layer formation and the resin pellet body for elastic layer formation were put into each single-screw extruder, and a resin for base layer formation and a resin for elastic layer formation were coextruded from the cylindrical die to obtain an endless-shaped laminated belt whose inner layer was polyvinylidene fluoride, outer layer was thermoplastic polyurethane, and width was 460 mm.

(Surface Modification of Elastic Layer)

In order to improve the adhesive property between the elastic layer and the surface layer, the outer peripheral surface of the elastic layer was surface-modified by irradiating the outer peripheral surface with ultraviolet rays using an excimer lamp (manufactured by M. D. COM. inc.) that emits a single wavelength of 172 nm as an excimer UV irradiation unit. Specifically, the laminated belt was fitted into a columnar core, and while the core existing at a distance of 1 mm from a surface of the excimer lamp was rotated at a rotation speed of 5 rpm, irradiation was carried out for 30 minutes in a space into which nitrogen gas was flowed.

(Preparation of PFPE Copolymer)

Preparation of PFPE Copolymer A

Raw perfluoropolyether (trade name: Fluorolink D10H, manufactured by Solvay Specialty Polymers Japan K.K., number average molecular weight 1200) (16.7 mmol) having —$CH_2$—OH at both ends of linear perfluoropolyether was added dropwise to a mixed solvent of acetonitrile (80 ml) and tetrahydrofuran (80 ml) in which sodium hydroxide (3.2 g) was dissolved. Then, the resultant solution was heated to a temperature of 55° C. under a nitrogen atmosphere. An 80% toluene solution (10 ml) of 3-bromo-1-propyne was added with stirring while maintaining the nitrogen atmosphere. Then, the reaction was carried out at a temperature of 55° C. for 3 days. Next, the obtained reaction solution was cooled to room temperature (temperature 25° C.), and solid matter was removed with a filter paper having a pore size of 7 μm. The solvent was removed from the obtained solution, and the mixture was dried in a vacuum oven at a temperature of 100° C. and a pressure of 1 Pa for 6 hours. Next, filtering was performed with a polytetrafluoroethylene filter having a particle retention capacity of 0.22 μm to obtain a compound S1 represented by the following structural formula.

Compound S1

$$HC{\equiv}CCH_2OCH_2-[OCF_2]_m-[OCF_2CF_2]_n-CH_2OCH_2C{\equiv}CH$$

0.5 mmol of the above compound T1, was dissolved in 40 ml of N, N-dimethylformamide, 0.325 g of sodium azide was added, and the mixture was stirred at a temperature of 25° C. for 2 days. Dichloromethane and water were put into the reaction solution, the organic layer was taken out and washed with ion-exchanged water three times. Magnesium sulfate was added to the washed organic layer for dehydration, then solid matter was removed with a filter paper having a pore size of 7 μm, and the solvent was removed from the obtained filtrate. The obtained solid matter was dissolved in dichloromethane, a process of adding diethyl ether to carry out reprecipitation was carried out twice to obtain a compound U1 represented by the following structural formula.

$$N_3-(CH_2CH_2O)_p-CH_3$$ Compound U1

The compound S1 (0.42 mmol) and the compound U1 (0.84 mmol) were added to N, N-dimethylformamide (20 ml), and nitrogen substitution was carried out for 30 minutes with stirring. In addition, copper (I) bromide (6.0 mg) and N, N, N', N'', N''-pentamethyldiethylenetriamine (7.0 mg) were added in a nitrogen-substituted state, and the mixture was stirred at a temperature of 25° C. for 24 hours. Diethyl ether at a temperature of 5° C. was added dropwise to the obtained solution, and solid matter was filtered off. A PEG-PFPE-PEG copolymer A represented by the chemical structural formula (1) was prepared by drying at a temperature of 25° C. and a pressure of 1 Pa for 24 hours.

PFPE is an abbreviation for perfluoropolyether, and PEG is an abbreviation for polyethylene glycol.

Chemical structural formula (1)

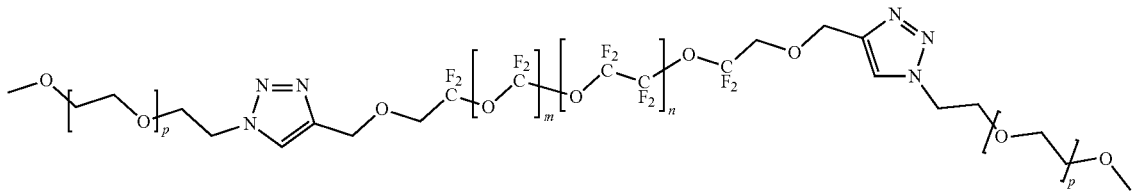

Polyethylene glycol monomethyl ether (1 mmol) (molecular weight 2,000) was added into a mixed solution of dichloromethane (super-dehydrated) (25 ml) and triethylamine (1.5 ml). p-Toluenesulfonyl chloride (1.91 g) was further added into this solution, replaced with nitrogen, and stirred at a temperature of 25° C. for 2 days. The obtained solution was washed twice with ion-exchanged water, an organic layer was taken out, and magnesium sulfate was added for dehydration. Then, solid matter was removed with a filter paper having a pore size of 7 μm, and the solvent was removed from the obtained solution. The obtained solid matter was dissolved in dichloromethane, a process of adding diethyl ether to carry out reprecipitation was carried out twice to obtain a compound T1 represented by the following structural formula.

Compound T1

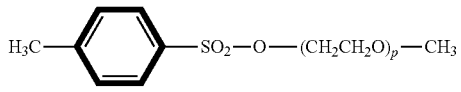

(p, m, and n are positive integers indicating the number of each repeating structural unit. In particular, the parts not having atomic symbols is composed only of carbon atom and hydrogen atom.)

Preparation of PFPE Copolymer B

A PFPE copolymer B was prepared in the same manner as the PFPE copolymer A except that polyethylene glycol monomethyl ether (molecular weight 2,000) was changed to poly(propylene glycol) monobutyl ether (molecular weight 2,000).

Preparation of PFPE Copolymer C

A PFPE copolymer C was prepared in the same manner as the PFPE copolymer A except that "Fomblin Z-DOL4000" (trade name, manufactured by Solvay Specialty Polymers Japan K.K., number average molecule=4000) was used instead of the raw perfluoropolyether having —$CH_2$—OH at both ends of linear perfluoropolyether.

Preparation of PFPE Copolymer D

A PFPE copolymer D was prepared in the same manner as the PFPE copolymer A except that polyethylene glycol monomethyl ether (molecular weight 2,000) was changed to polyethylene glycol monomethyl ether (molecular weight 1,000).

Preparation of PFPE Copolymer E

A PFPE copolymer E was prepared in the same manner as the PFPE copolymer C except that polyethylene glycol monomethyl ether (molecular weight 2,000) was changed to polyethylene glycol monomethyl ether (molecular weight 4,000).

A list of the PFPE copolymers A to E is shown in Table 3.

TABLE 3

| | Oxyalkylene site | | PFPE site | |
|---|---|---|---|---|
| PFPE copolymer | Structure | Number average molecular weight (Mn1) | Number average molecular weight (Mn2) | (Mn1/Mn2) |
| A | Ethylene glycol | 2000 | 1200 | 1.7 |
| B | Propylene glycol | 2000 | 1200 | 1.7 |
| C | Ethylene glycol | 2000 | 4000 | 0.5 |
| D | Ethylene glycol | 1000 | 1200 | 0.8 |
| E | Ethylene glycol | 4000 | 4000 | 1.0 |

(Preparation of Paint for Surface Layer)

Preparation of PTFE Dispersion I-A

A PTFE dispersion I-A was prepared as a preliminary step to prepare a paint for a surface layer. Specifically, the materials described in Table 4 below were premixed with a homogenizer and then dispersed with a high-pressure homogenizer to obtain the PTFE dispersion I-A.

TABLE 4

| Material | Blending amount (parts by mass) |
|---|---|
| Polytetrafluoroethylene particles (trade name: TLP10F-1; manufactured by Chemours-Mitsui Fluoroproducts Co., Ltd.) * Number average particle diameter 350 nm | 40 |
| PFPE Copolymer A | 3 |
| Pure water | 60 |

Preparation of PTFE Dispersions I-B to I-E

A dispersion was prepared in the same manner as the PTFE dispersion I-A except that the PFPE copolymer shown in Table 5 was used as a dispersant to obtain PTFE dispersions I-B to I-E.

TABLE 5

| | PTFE particles | | Dispersant | | Pure water |
|---|---|---|---|---|---|
| PTFE Dispersion | Type | Parts by mass | Type | Parts by mass | Parts by mass |
| I-A | TLP10F-1 | 40 | PFPE copolymer A | 3 | 60 |
| I-B | TLP10F-1 | 40 | PFPE copolymer B | 3 | 60 |
| I-C | TLP10F-1 | 40 | PFPE copolymer C | 3 | 60 |
| I-D | TLP10F-1 | 40 | PFPE copolymer D | 3 | 60 |
| I-E | TLP10F-1 | 40 | PFPE copolymer E | 3 | 60 |

Preparation of Paint 1-A for Surface Layer

The PTFE dispersion I-A and a polyurethane resin liquid (trade name: Hydran WLS-201, manufactured by DIC Corporation, solid content ratio 35%, viscosity at 25° C.: 150 mPa·s) were mixed in the following ratio to obtain a paint 1-A for a surface layer.

| | |
|---|---|
| PTFE dispersion I-A | 30 parts by mass |
| Polyurethane resin liquid | 70 parts by mass |

Preparation of Paint 1-B for Surface Layer

A paint 1-B for a surface layer was obtained in the same manner as the paint 1-A except that the PTFE dispersion I-A was changed to the PTFE dispersion I-B.

Preparation of Paint 1-C for Surface Layer

A paint 1-C for a surface layer was obtained in the same manner as the paint 1-A except that the PTFE dispersion I-A was changed to the PTFE dispersion I-C.

Preparation of Paint 1-D for Surface Layer

A paint 1-D for a surface layer was obtained in the same manner as the paint 1-A except that the PTFE dispersion I-A was changed to the PTFE dispersion I-D.

Preparation of Paint 1-E for Surface Layer

A paint 1-E for a surface layer was obtained in the same manner as the paint 1-A except that the PTFE dispersion I-A was changed to the PTFE dispersion I-E.

Preparation of Paint 2-A for Surface Layer

A paint 2-A for a surface layer was prepared in the same manner as the paint 1-A except that the polyurethane resin liquid was changed to "UCECOAT 7850" (trade name, manufactured by Daicel-Allnex Ltd.).

"UCECOAT 7850" is a dispersion type water-dispersed resin having the following physical properties.

Solid content ratio 35%, • Average particle size: less than 100 nm, •Viscosity at 25° C.: 200 mPa·s, •Weight average molecular weight 10,000.

Preparation of Paint 3-A for Surface Layer

"Fluon PTFE AD915E" (trade name, manufactured by AGC Inc.) was used as the PTFE dispersion, a polyurethane resin liquid (trade name: Hydran WLS-201, manufactured by DIC Corporation, solid content ratio 30%) was mixed in the following ratio to prepare a paint 3-A for a surface layer. The solid content ratio of "Fluon PTFE AD915E" was 61%, the average particle size of PTFE particles was 0.25 μm, and the viscosity at a temperature of 23° C. was 19 mPa·s. The dispersant for the PTFE particles contained in "Fluon PTFE AD915E" was a polyoxyalkylene alkyl ether. That is, no perfluoropolyether structure was included.

| | |
|---|---|
| PTFE dispersion | 20 parts by mass |
| Polyurethane resin liquid | 80 parts by mass |

Example 1

The laminated belt produced above in which the outer peripheral surface of the elastic layer was surface-modified was fitted into a core, and while the core was rotated at 90 rpm, the paint 1-A for a surface layer was applied onto the outer peripheral surface of the elastic layer using a spray gun (trade name: W-101, manufactured by ANEST IWATA Corporation). A discharge amount of the paint at the time of application was set so that a dry film thickness of a coating film of the paint 1-A for a surface layer was 3 μm. The laminated belt on which the coating film of the paint 1-A for a surface layer was formed was heated in a heating furnace at a temperature of 130° C. for 30 minutes. Then, the laminated belt was taken out from the heating furnace to obtain an electrophotographic belt 1.

The obtained electrophotographic belt 1 was attached as an intermediate transfer belt to an electrophotographic image forming apparatus (trade name: image RUNNER ADVANCE C7580; manufactured by Canon Inc.), and 30,000 sheets of electrophotographic images were continuously formed under the following conditions.

Temperature: 23° C., Relative humidity: 50%

Paper used: GF-C081 A3 size (basis weight 81.4 g/m$^2$, thickness 97 μm, whiteness about 100%, manufactured by Canon Inc.)

Printed image: Amount of CMYK toner loaded on intermediate transfer belt 0.4 mg/cm$^2$, image ratio 100%.

The evaluation was performed on the following two points.

[(Evaluation 1) Abnormal Noise/Curling of Cleaning Unit]

During the printing of 30,000 sheets of the electrophotographic images, if a sound that did not occur in normal printing was heard from a cleaning unit (hereinafter referred to as CLN unit) of a transfer unit, it was determined that an abnormal noise occurred.

As shown in FIG. 3, a blade holding member 31 holds an upper side surface 32*a* of the cleaning blade 32. Normally, the vicinity of a tip of a lower side surface 32*b* opposite to the upper side surface 32*a* of the cleaning blade 32 came in contact with the outer peripheral surface of the intermediate transfer belt 7, and while the intermediate transfer belt 7 travels in a direction of an arrow 34, the outer peripheral surface of the intermediate transfer belt 7 was cleaned. When the vicinity of a tip of the upper side surface 32*a* of the cleaning blade 32 came into contact with the outer peripheral surface of the intermediate transfer belt 7, it was judged that the "blade was curled". These observation results were evaluated according to the following criteria.

Rank A: No abnormal noise was observed, and no blade curling was observed.

Rank B: Either abnormal noise or blade curling was observed.

[(Evaluation 2) Outer Surface of Electrophotographic Belt]

After printing of 30,000 sheets of the electrophotographic images, the electrophotographic belt was taken out from the electrophotographic image forming apparatus, and the entire outer surface was cleaned with a cleaning wiper (trade name: Dasper μ; manufactured by Ozu Corporation). Then, the outer surface was observed with an optical microscope at a magnification of 50 times, a magnification of 200 times, and a magnification of 1,000 times, and evaluated according to the following criteria.

Rank A: No toner lumps with a maximum feret diameter of 20 μm or more were confirmed.

Rank B: Toner lump with a maximum feret diameter of 20 μm or more was confirmed.

Examples 2 to 5

Electrophotographic belts 2 to 5 were produced and evaluated in the same manner as in Example 1 except that the paint for a surface layer shown in Table 6 was used.

Example 6

A coating film of the paint 2-A for a surface layer was formed on the outer peripheral surface of the laminated belt in the same manner as in Example 1 except that the paint 2-A for a surface layer was used. Next, the coating film of the paint 2-A for a surface layer was irradiated with ultraviolet light having a wavelength of 365 nm using a high-pressure mercury lamp so that an integrated light amount was 2 J/cm$^2$, the coating film was cured, and an electrophotographic belt 6 according to this example was produced. The obtained electrophotographic belt 6 was evaluated in the same manner as in Example 1.

Comparative Example 1

An electrophotographic belt was produced and evaluated in the same manner as in Example 1 except that paint 1-A for a surface layer was changed to the paint 3-A for a surface layer. The evaluation results were shown in Table 6.

TABLE 6

| | Paint for surface layer | PTFE dispersion Type | PTFE dispersion Parts by mass | Polyurethane resin liquid Type | Polyurethane resin liquid Parts by mass | Evaluation rank Evaluation 1 | Evaluation rank Evaluation 2 |
|---|---|---|---|---|---|---|---|
| Example 1 | 1-A | I-A | 30 | "Hydran WLS-201" | 70 | A | A |
| Example 2 | 1-B | I-B | 30 | "Hydran WLS-201" | 70 | A | A |
| Example 3 | 1-C | I-C | 30 | "Hydran WLS-201" | 70 | A | A |
| Example 4 | 1-D | I-D | 30 | "Hydran WLS-201" | 70 | A | A |
| Example 5 | 1-E | I-E | 30 | "Hydran WLS-201" | 70 | A | A |
| Example 6 | 2-A | I-A | 30 | "UCECOAT 7850" | 70 | A | A |
| Comparative Example 1 | 3-A | "AD915E" | 20 | "Hydran WLS-201" | 80 | B | B |

From the evaluation results shown in Table 6, it was found that the use of the compound having a perfluoropolyether structure and an oxyalkylene structure did not cause a defect in the cleaning unit or adhesion of toner to an ITB surface. It is presumed that this is because a dispersed state of the polytetrafluoroethylene (PTFE) particles in the surface layer containing the compound having a perfluoropolyether structure and an oxyalkylene structure is good. It is presumed that if the dispersed state of the PTFE particles is good, as a result of printing on a large amount of paper, the surface layer of the electrophotographic belt is slightly scraped, and even if a portion closer to the elastic layer becomes the outermost surface, since the dispersed state of the PTFE particles does not change, the toner releasability and the cleaning properties do not change.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-081497, filed May 1, 2020, and Japanese Patent Application No. 2021-064773, filed Apr. 6, 2021, which are hereby incorporated by reference herein in their entirety.

What is claimed is:

1. An electrophotographic belt having an endless shape, comprising:

an endless-shaped base layer;

an elastic layer on an outer peripheral surface of the base layer; and a surface layer on the outer peripheral surface of the elastic layer, wherein the surface layer comprises:

a urethane resin as a binder;

polytetrafluoroethylene particles, and a compound having a perfluoropolyether structure and an oxyalkylene structure.

2. The electrophotographic belt according to claim 1, wherein the oxyalkylene structure is an oxyethylene structure or an oxypropylene structure.

3. The electrophotographic belt according to claim 1, wherein a number average molecular weight of the perfluoropolyether structure is 500 to 10,000.

4. The electrophotographic belt according to claim 1, wherein the perfluoropolyether structure is at least one structure selected from the group consisting of structures represented by the following structural formulae (i) to (iv):

$$—CF_2O— \quad (i)$$

$$—CF_2CF_2O— \quad (ii)$$

$$—CF_2CF_2CF_2O— \quad (iii)$$

$$—CF(CF_3)CF_2O— \quad (iv).$$

5. The electrophotographic belt according to claim 1, wherein when a number average molecular weight of the oxyalkylene structure is defined as Mn1 and the number average molecular weight of the perfluoropolyether structure is defined as Mn2, a value of (Mn1/Mn2) is 0.3 to 2.0.

6. The electrophotographic belt according to claim 5, wherein the value of (Mn1/Mn2) is 0.5 to 1.0.

7. The electrophotographic belt according to claim 1, wherein the base layer has a thickness of 10 to 500 μm.

8. The electrophotographic belt according to claim 1, wherein the elastic layer has a thickness of 100 to 1000 μm.

9. The electrophotographic belt according to claim 1, wherein the surface layer has a thickness of 0.5 to 20 μm.

10. The electrophotographic belt according to claim 1, wherein a number average particle diameter of the polytetrafluoroethylene particles is in a range of 0.05 to 1.80 μm.

11. An electrophotographic image forming apparatus, comprising:

an image carrier that carries a toner image; and an intermediate transfer belt that carries and conveys the toner image primarily transferred from the image carrier so as to secondarily transfer the toner image onto a transfer material, wherein the intermediate transfer belt is an electrophotographic belt having an endless shape, comprising an endless-shaped base layer, an elastic layer on an outer peripheral surface of the base layer, and a surface layer on the outer peripheral surface of the elastic layer, wherein the surface layer comprises a urethane resin as a binder, polytetrafluoroethylene particles, and a compound having a perfluoropolyether structure and an oxyalkylene structure.

12. The electrophotographic image forming apparatus according to claim 11, further comprising a cleaning member, wherein in the cleaning member, at least a portion of the cleaning member is disposed in contact with an outer surface of the surface layer of the electrophotographic belt.

13. The electrophotographic image forming apparatus according to claim 12, wherein the cleaning member is a cleaning roller.

14. The electrophotographic image forming apparatus according to claim 12, wherein the cleaning member is a cleaning blade.

* * * * *